US005626507A

United States Patent [19]

Gillen

[11] Patent Number: 5,626,507

[45] Date of Patent: May 6, 1997

[54] PAD FOR SHOULDER STRAPS

[76] Inventor: Frederick H. Gillen, 194 Delaware Trail, Akron, Ohio 44321

[21] Appl. No.: 549,330

[22] Filed: Oct. 27, 1995

[51] Int. Cl.[6] ..... A41D 27/26

[52] U.S. Cl. ..... 450/86; 2/268; 2/459; 2/460; 2/461

[58] Field of Search ..... 2/267, 268, 403, 2/2.5, 459, 460, 461; 450/41, 42, 43, 44, 45, 46, 47, 48, 49, 50, 51, 52, 38, 86, 53, 54, 55, 56, 57; 24/264, 643

[56] References Cited

U.S. PATENT DOCUMENTS

| | | | |
|---|---|---|---|
| Re. 22,771 | 7/1946 | Light | 450/52 |
| 146,805 | 1/1874 | Cox | 450/38 |
| 238,066 | 2/1881 | Stern | 2/268 |
| 282,627 | 8/1883 | Gensch | 450/38 X |
| 990,279 | 4/1911 | Mayer et al. | 2/267 |
| 1,026,326 | 5/1912 | Leporun | 450/56 |
| 2,304,669 | 12/1942 | Levy | 2/268 |
| 2,304,699 | 12/1942 | Levy | 2/268 |
| 2,497,992 | 2/1950 | Jacques | 2/268 |
| 2,501,749 | 9/1950 | Trent | 2/2 |
| 2,619,650 | 12/1952 | Lerma | 2/268 |
| 2,620,484 | 12/1952 | Gerry | 2/268 |
| 2,697,229 | 12/1954 | Krueger | 450/38 |
| 2,786,209 | 3/1957 | Kleinman | 2/268 |
| 3,025,859 | 9/1962 | Rosenberg | 128/510 |
| 3,050,734 | 8/1962 | Dopyera | 2/268 |
| 3,559,214 | 2/1971 | Pangman | 450/38 |
| 4,100,924 | 7/1978 | Rosenberg | 128/510 |
| 4,217,906 | 8/1980 | Perron | 128/510 |
| 4,235,240 | 11/1980 | Cousins | 450/52 |
| 4,472,838 | 9/1984 | Pompa | 2/268 |
| 4,795,400 | 1/1989 | Greenberg | 450/86 |
| 4,945,576 | 8/1990 | Melton | 2/268 |
| 5,244,432 | 9/1993 | Moy Au et al. | 2/267 |
| 5,281,186 | 1/1994 | Buckley et al. | 450/38 X |
| 5,307,966 | 5/1994 | Inaba et al. | 224/264 |

*Primary Examiner*—Jeanette E. Chapman
*Attorney, Agent, or Firm*—Reese Taylor

[57] ABSTRACT

A pad for attachment to a strap, such as the shoulder strap of an article such as a brassiere, includes a fluid-filled envelope, slidable over the strap for eventual positioning over the shoulders of the wearer. A fabric cover may be placed over the envelope and attachment tabs may be secured to either the envelope or the cover to securely position the envelope relative to the strap during use. A modified form of the invention includes a second pair of fluid-filled envelopes affixed to the lower edges of the cups of a brassiere.

9 Claims, 3 Drawing Sheets

PAD FOR SHOULDER STRAPS

FIELD OF THE INVENTION

This invention relates in general to pads for shoulder straps and relates in particular to pads intended for use on the shoulder straps of brassieres.

BACKGROUND OF THE INVENTION

In the prior art, it is known that in many instances brassieres, particularly in the larger sizes, tend to irritate the shoulders of the wearer due to the weight supported, inasmuch as a considerable portion of that weight is directed through the shoulder straps to a very narrow contact area of the body. The result is well known and includes discomfort to the wearer and the development of unsightly ridges and/or irritation to the skin.

The prior art discloses numerous attempts at solutions to this problem. For example, several prior art patents disclose removable pads to be attached to the shoulder, such as can be seen in Trent U.S. Pat. No. 2,501,749 and Melton U.S. Pat. No. 4,945,576. These pads are fabricated from various materials and generally are wider than the brassiere straps themselves so as to presumably distribute the weight better to the wearer's shoulders and eliminate some of the just mentioned problems.

Other patents, such as Rosenberg U.S. Pat. Nos. 3,025,859 and 4,100,924 show further attempts to eliminate the problem by simply widening the straps themselves in the shoulder engaging areas.

Perron U.S. Pat. No. 4,217,906 shows the use of filler strips while Pompa U.S. Pat. No. 4,472,838 discloses the utilization of sheepskin or lambskin pads disposed on the shoulder straps so as to present a sorer skin engaging surface.

Greenberg U.S. Pat. No. 4,795,400 shows a further attempt to solve this problem by the use of a foam laminate band attached to the shoulder strap.

While all of the prior art just described is presumably suitable for the purposes for which it is designed, it is believed that a still further improvement can be made by providing a floating type pad which can be removably attached to the shoulder straps whereby the ridges caused by the straps themselves can be eliminated and, therefore, the discomfort encountered by the wearers will be minimized.

SUMMARY OF THE INVENTION

It is accordingly the principal object of this invention to provide a pad for a shoulder strap for garments, such as brassieres, which will substantially reduce the discomfort to wearers of the garments.

In furtherance of this object, it has been found that if a floating type pad can be produced and filled either with a non-staining liquid or other fluid or a gel of some sort, such a pad will better distribute the weight and minimize the discomfort of the user.

It has been further found that such a pad can be produced by providing a substantially dosed but expandable envelope. In one form of the invention the envelope can be provided with inflation means wherein air or other fluid can be injected into the closed envelope. In another form of the invention the envelope can be substantially permanently filled with a non-staining fluid, gel or foam material.

It has been found that, in either case, the envelope can be provided with a through central passageway extending from end to end thereof whereby it can be readily slipped over the existing brassiere straps.

It has also been found that attachment means can be provided on the opposed ends of the pads so as to make it possible to temporarily position the pad relative to the length of the brassiere strap to avoid inadvertent shifting movement during wearing of the same.

It has further been found that a fabric or cloth cover can be provided about the external surface of the pad so as to present a more comfortable skin engaging surface for the wearer.

Finally, it has been found that still further comfort can be provided in the breast areas by providing a similarly filled pad along the bottom edges of the cups to prevent the irritation and discomfort often encountered in that area as well.

Accordingly, production of an improved pad for a shoulder strap of the character above described becomes the principal object of this invention with other objects thereof becoming more apparent upon a reading of the following specification considered and interpreted in view of the accompanying drawings.

BRIEF DESCRIPTION OF THE PREFERRED EMBODIMENTS

Figure 1:
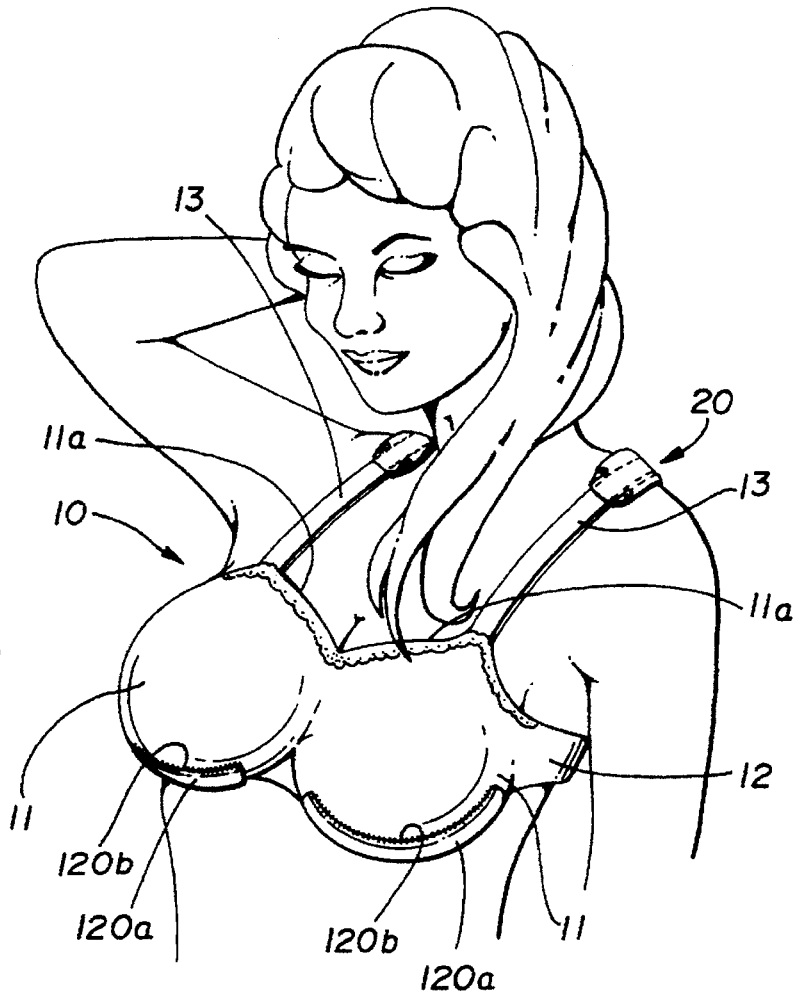
FIG. 1 is a perspective view of the improved pad in place on a wearer.

Referring first to FIG. 1 of the drawings, it will be seen that the typical brassiere, generally indicated by the numeral 10, consists of cups 11,11 and a back strap 12 with shoulder straps 13,13 extending from the top edges *11a,11a* of cups 11,11 to the back strap 12. As is obvious from the drawings and known in the art, this style of garment is worn with the back strap 12 passing around the user's back adjacent the shoulder blades and with the shoulder straps passing over the shoulders. The usual adjustment means for the shoulder and back straps are not shown, being well known, and it is also contemplated that the shoulder and back straps could be of the elastic type. For purposes of the present invention, the particular style of the brassiere is not particularly relevant.

No detail beyond the above has been illustrated herein or will be described herein inasmuch as the conventional brassiere construction is well known in the art. Suffice it to say that, from FIG. 1 of the drawings, it will be seen that the improved pads 20, when in place on the straps 13,13, as will be further described below, rest on the shoulders of the wearer where the maximum weight is received.

Figure 2:
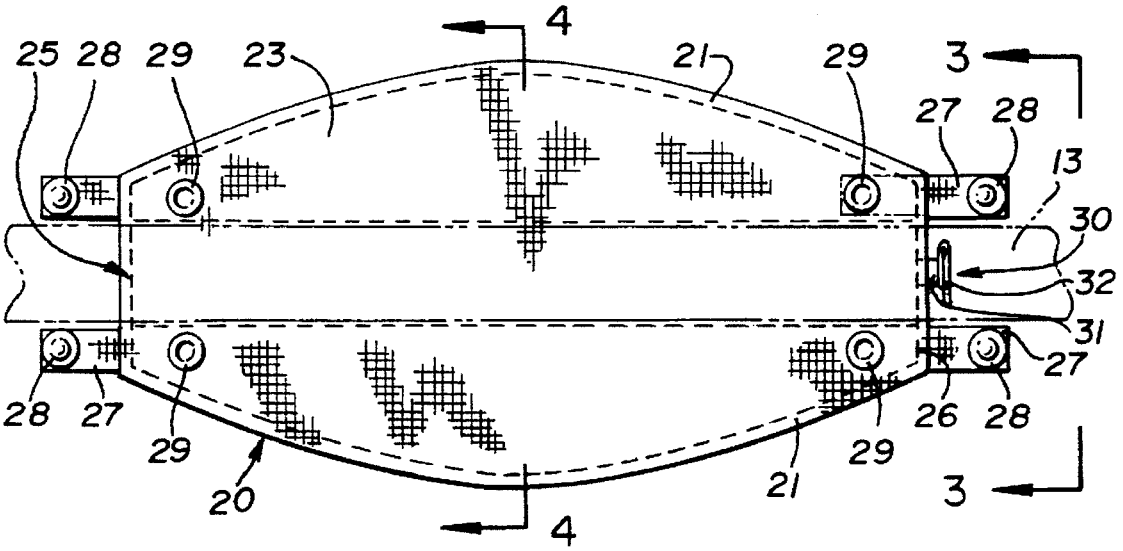
FIG. 2 is a top plan view of the improved pad in place on the brassiere strap.
Figure 3:
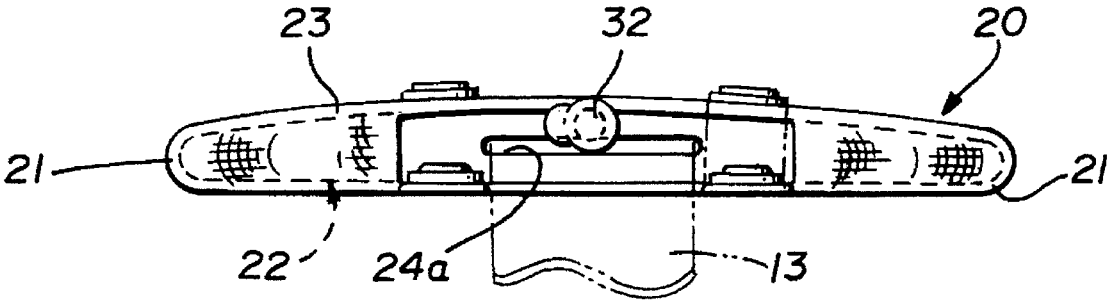
FIG. 3 is a sectional view taken along the line 3—3 of FIG. 2.
Figure 4:
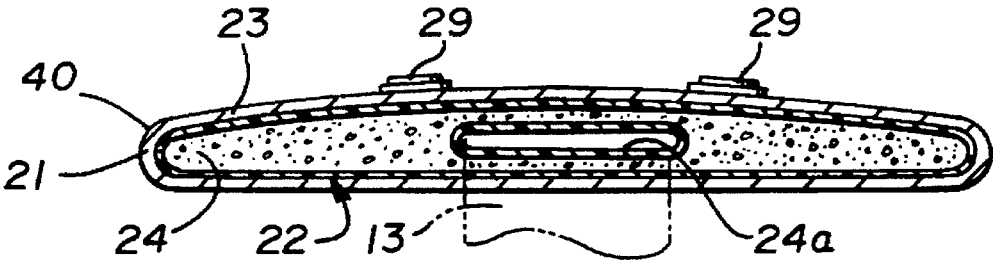
FIG. 4 is a sectional view taken along the line 4—4 of FIG. 2.
Figure 5:
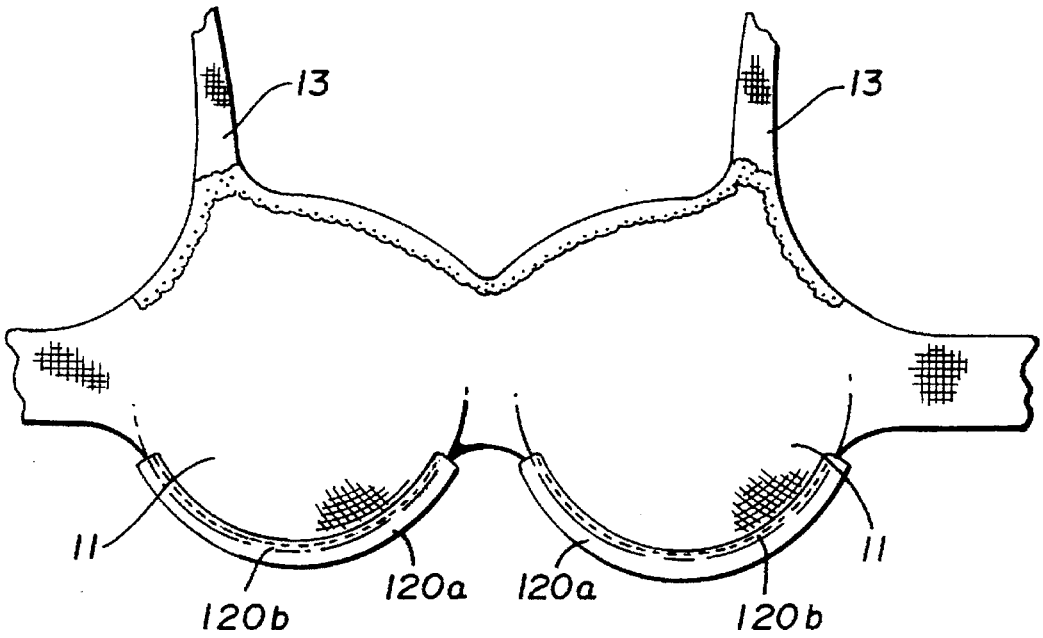
FIG. 5 is a front elevational view showing the cup cushioning pads in place.
Figure 6:
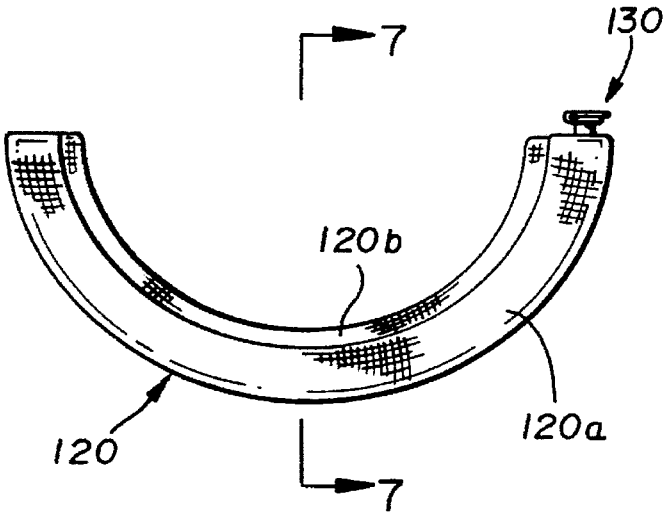
FIG. 6 is an elevational view of the cup cushioning pad.
Figure 7:
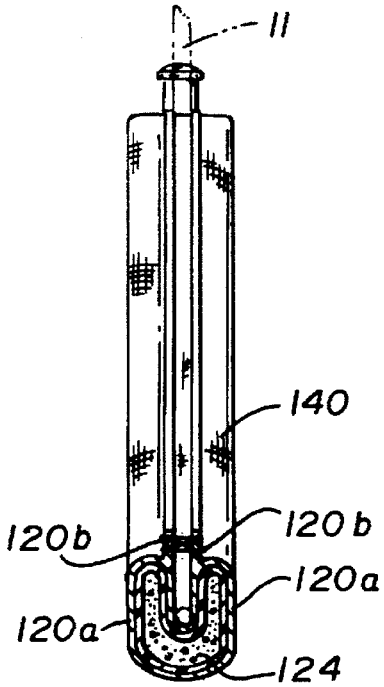
FIG. 7 is a sectional view taken along the line 7—7 of FIG. 6.

Referring next then to FIGS. 2, 3, and 4 for a more detailed description of the improved pad, it will be noted that the pad, generally indicated by the numeral 20, has opposed sidewalls 21,21 and opposed top and bottom walls 23 and 24 and opposed end walls 25 and 26. These various walls are joined together in any conventional fashion such as stitching, heat sealing, etc., so as to form a fluid-tight envelope with a hollow interior. It will be noted also that the sidewalls 21,21 and top and bottom walls 23,24 bow out away from the ends 25 and 26 when viewed in plan so as to provide a broader area of support for weight transferal purposes when in use.

Still referring to FIGS. 2, 3 and 4 of the drawings, it will be noted that a fabric cover 40 is optionally disposed over the exterior surface of the pad 20. The pad 20 will preferably be made of some sort of expandable material such as an elastomer. That being the case, and depending upon the specific material used, the material may not have particularly desirable skin contacting characteristics and, therefore, the fabric cover 40 may be interposed between the skin of the wearer and the actual body surface of the pad 20 itself for greater comfort.

As previously noted, the pad 20 has opposed ends 25 and 26 and at one of those ends inflation means 30 are provided. These means generally include a tube 31 projecting from the end 26 in the drawings and a press fit cap 32 which may be attached to or integral with tube 31 and which can be employed to close off the end of the tube 31 to form a fluid-tight seal. It is contemplated that air, liquid or other fluid material may be injected into the pad 20 through the tube 31. In that way, the envelope body of pad 20 will inflate and provide a cushioning effect when worn. In the event a liquid is employed, a non-staining material is preferred to avoid contaminating or staining the brassiere itself or other clothing.

An alternative form of the invention contemplates more or less permanently filling the envelope body of the pad 20 with a liquid gel or even a foam material. It is contemplated that this could be done during manufacture or, if desired, by the user who may find that a greater or lesser amount of filler is individually preferred.

Attachment means are also provided in association with the pad 20. In the form of the invention illustrated in the drawings, the attachment means, which consist of attachment tabs 27,27 projecting from the opposed ends of the improved pad 20, are secured by stitching or otherwise to the fabric cover 40. If the fabric cover 40 is not believed necessary due to the characteristics of the material from which pad 20 is fabricated, it is possible that the tabs 27,27 could be secured directly to the body of the pad itself. In either case, attachment tabs 27,27 are effectively carried on the pad 20 in order to securely position it relatively of the shoulder straps 13,13.

In the form of the invention shown, the attachment tabs 27,27 carry female connectors 29,29 while male connectors 28,28 are provided on the attachment tabs 27,27 so that they can be snapped together. This form of connector is exemplary only and alternative types of releasable connectors, such as Velcro®, for example, could be used within the scope of the present invention. The object, regardless of the specific connector used, is to secure each pad 20 relatively of the shoulder strap 13 so as to maintain it more or less in place while it is being worn.

Finally, it will be noted, particularly from FIGS. 3 and 4 of the drawings, that a through central passageway **24*a* is provided in the envelope of each pad 20 and this passageway 24*a* is sized so as to permit the shoulder strap 13,13** to be inserted through it.

In use, of course, it is simply necessary to insert the shoulder straps 13,13 through this central passageway **24*a* and slide each pad 20 onto a strap and into position, following which the attachment tabs 27,27 can be utilized to hold the pads in the desired position. If the interior of the pad 20 is permanently filled with gel or foam material, nothing more need be done. If it is intended to be temporarily filled with air or other fluid, this can be done through the inflation means 30**, either prior to insertion onto the straps or after, as desired.

In accordance with the general object of the invention, to enhance the comfort of the wearer, it is also known that often the bottom edges of the brassiere cups 11,11 may dig into the skin of the wearer. This problem is primarily caused by the fact that the lower edges of the cups are often reinforced by a wire or similar article to provide uplift. However, the same reinforcement is fairly rigid and may also impinge on the underlying skin and adversely affect it.

Therefore, in a modified form of the invention, in furtherance of the general object of increasing comfort for the wearer, semi-circular pads 120,120, filled as pads 20, can be positioned about the lower edges of the cups 11,11. Referring to FIGS. 1 and 5 through 7 of the drawings, it will be seen that fluid filled pads 120,120 are provided for positioning along the lower edges of cups 11,11. These pads 120,120 may be constructed similarly to pad 20 to the extent that they provide a fluid-tight interior 124 and inflation or filling means 130 to the extent that they may be temporarily or permanently filled as previously described with reference to pad 20. However, these pads 120,120 would normally have a generally U-shaped configuration so as to be able to fit around the generally arcuate lower edge of the cups and also would include longitudinally extending flaps **120*b*,120*b* which can be attached to the cup itself as by stitching 120*a*. They may also receive a cover such as 140, similar to the previously described cover 40**, and may be permanently attached to the lower edges of the cups by the edges of the cover as shown in the drawings.

Such pads will provide a similar cushioning effect as pads 20,20 and thereby further enhance the comfort of the wearer while still providing the uplift effect.

In this form of the invention, and particularly where pads 120 are affixed at the point of manufacture, they could merely be affixed about the conventional wire or other reinforcement along the bottom of the cup.

While a full and complete description has been set forth in accordance with the dictates of the patent statutes, it should be understood that modifications can be resorted thereto without departing from the spirit hereof or the scope of the appended claims.

Thus, while the pads for attachment to the shoulder pads have been illustrated and described with reference to brassiere straps, it is believed apparent that they could have equal utility with any garment or the like which includes shoulder straps which support articles having any appreciable weight.

Also, it will be noted that no specific filler material has been specified. Other than the requirement that if a liquid is utilized, it be preferably non-staining, it is believed that the selection of the filling medium would be within the skill of one knowledgeable in the art.

What is claimed is:

1. A pad for a shoulder strap, comprising:

(a) a substantially closed, expandable envelope fabricated from a substantially fluid impermeable material; said envelope having (1) opposed top and bottom walls, (2) opposed side walls, and (3) opposed end walls; said opposed side walls and opposed end walls being joined together to form a substantially fluid-tight, hollow body;

(b) a through, central, strap-receiving passageway extending between said end walls; and (c) means for securing said envelope to the shoulder strap.

2. The pad of claim 1 further characterized by inflation means disposed in one end wall of said envelope whereby said envelope may be inflated.

3. The pad of claim 1 wherein said means for securing said envelope to the strap includes at least one attachment tab secured to and projecting from each of said end walls.

4. The pad of claim 3 wherein mating attachment means are carried on said top wall adjacent said end walls and said attachment tabs for releasable engagement therewith.

5. The pad of claim 1 wherein said hollow body is filled with a compressible substance.

6. The pad of claim 1 or claim 5 wherein a fabric cover is received over the exterior of said envelope; and said means for securing said envelope to the shoulder strap are disposed on said cover.

7. The pad of claim 1 wherein said shoulder strap is part of a brassiere and wherein inflatable pads are releasably affixed to the lower edges of the cups thereof.

8. The pad of claim 1 wherein said substantially closed, expandable envelope is adapted to support weight on said top and bottom walls.

9. A pad for a brassiere, comprising:

(a) a substantially fluid-tight, hollow body;

(b) said body having opposed top and bottom walls, opposed side walls and opposed end walls;

(c) means for joining said opposed walls to withstand increased pressure in said hollow body created by forces on said top and bottom walls;

(d) said body being selectively attachable to the brassiere; and (e) said body having a through, central, strap-receiving passageway extending between said end walls.

* * * * *